United States Patent [19]

Schmidt et al.

[11] Patent Number: 4,901,240

[45] Date of Patent: Feb. 13, 1990

[54] METHOD AND APPARATUS FOR CONTROLLING THE OPERATING CHARACTERISTIC QUANTITIES OF AN INTERNAL COMBUSTION ENGINE

[75] Inventors: Peter J. Schmidt; Manfred Schmitt, both of Schwieberdingen, Fed. Rep. of Germany

[73] Assignee: Robert Bosch GmbH, Stuttgart, Fed. Rep. of Germany

[21] Appl. No.: 6,696

[22] Filed: Jan. 21, 1987

[30] Foreign Application Priority Data

Feb. 1, 1986 [DE] Fed. Rep. of Germany ..... 3603137

[51] Int. Cl.[4] ..... F02D 41/26; F02D 41/30; F02B 3/12

[52] U.S. Cl. ..... 364/431.06; 123/438; 123/440; 123/486

[58] Field of Search ..... 60/602; 723/489, 349, 723/480, 486, 342, 436, 438; 364/431.04, 431.06

[56] References Cited

U.S. PATENT DOCUMENTS

| | | | |
|---|---|---|---|
| 4,235,204 | 11/1980 | Rice | 123/480 |
| 4,348,727 | 9/1982 | Kobayashi et al. | 364/431.06 |
| 4,487,186 | 12/1984 | Wahl et al. | 123/436 |
| 4,625,699 | 12/1986 | Kobayashi et al. | 123/489 |
| 4,646,697 | 3/1987 | Grob et al. | 123/440 |
| 4,664,086 | 5/1987 | Takeda et al. | 123/489 |
| 4,674,459 | 6/1987 | Blöcher et al. | 123/486 |
| 4,676,215 | 6/1987 | Blo her et al. | 123/489 |
| 4,715,344 | 12/1987 | Tomisawa | 123/489 |
| 4,732,003 | 3/1988 | Ueno et al. | 60/602 |
| 4,733,357 | 3/1988 | Abe | 364/431.03 |
| 4,827,937 | 5/1989 | Kohler et al. | 123/486 |

*Primary Examiner*—Felix D. Gruber
*Attorney, Agent, or Firm*—Walter Ottesen

[57] ABSTRACT

In a method and an apparatus for open-loop and closed-loop control of operating characteristic quantities of an internal combustion engine, it is proposed that the anticipatory or pilot control area, which is variable by means of learning, be embodied such that in a factor characteristic field associated with a basic characteristic field, not only the particular support point but with decreasing influence outward the area surrounding it as well are changed by the carry-over of an averaged regulating factor value. Alternatively, or preferably combined therewith, the factor characteristic field is replaced by at least two correcting characteristic fields, which have larger inclusion areas, overlapping one another, for each support point, so that even in the event of fluctuations of input quantities about a border of an area, at least one of the correcting characteristic fields will be addressed.

8 Claims, 7 Drawing Sheets

FIG. 7

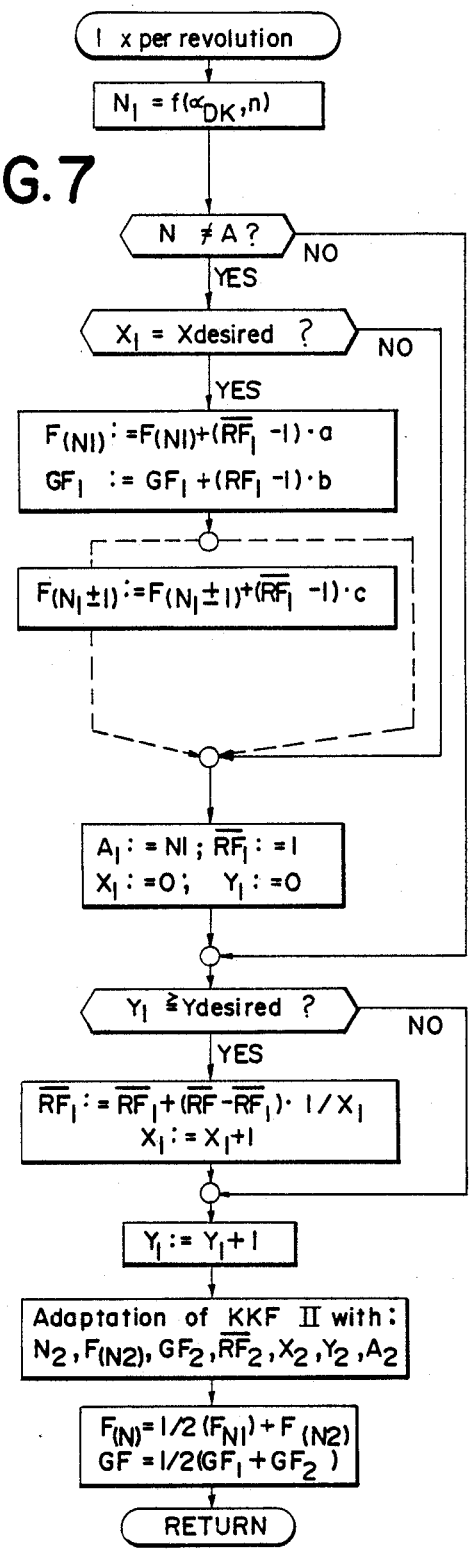

Calculation of the characteristic field address $N_1$ of the correcting Factor $F_1$ (separate for both correcting characteristic fields)

Change of address ?

Averaging time elapsed ?

Recalculation of the addressed correction factor

Global Factor (optional)

Recalculation of the surrounding correction factors (tent-roof effect with combination of both learn methods, tent-roof and overlapping)

Alternate branch routes with or without tent-roof effect

Set initial values: correction factor address averaged regulating factor averaging time counter rise time counter Transient time elapsed ?.

Averaging of the regulating factor Averaging time counter

Transient time counter

Adaptation of correcting characteristic field II:

Corresponds to that of KKFI

Calculation of total correction quantities: (not part of the learning strategy, but rather part of the characteristic field intervention)

METHOD AND APPARATUS FOR CONTROLLING THE OPERATING CHARACTERISTIC QUANTITIES OF AN INTERNAL COMBUSTION ENGINE

FIELD OF THE INVENTION

The invention relates to a method for open-loop and closed-loop control of operating characteristic quantities of an internal combustion engine. The method includes a characteristic field of engine operating quantities for anticipatory control of engine variables influencing the operating characteristic quantities. A control device that is sensitive to at least one engine variable, as an actual value, correctively influences the emitted characteristic field values (superposed control). The values stored in the characteristic field and addressed as a function of engine operating quantities are changed via the control device to correct the characteristic field values (adaptation by learning). An apparatus for performing the method is also disclosed.

BACKGROUND OF THE INVENTION

It is known to embody mixture metering systems for internal combustion engines in such a way that fuel metering is effected via so-called learning, or adaptive, closed-loop control or regulating systems. In this connection, reference can be made to U.S. Pats. No. 4,487,186 and 4,715,344. A learning regulating system of this kind has values for the injection, for example stored in a characteristic field, and these values can then be copied into a read-write memory each time the engine is started. By means of the characteristic fields, fast-reacting pilot or anticipatory control for the injection, for example, or generally for fuel metering or other quantities that must be adapted as quickly as possible to varying operating conditions of an internal combustion engine, such as the instant of ignition, the rate of exhaust gas recirculation and the like, are obtained. To achieve learning regulating systems here, the various characteristic field values can be corrected as a function of operating characteristics and then written into the appropriate memory.

In connection with the above, U.S. Pat. No. 4,676,215 and U.S. Pat. No. 4,827,937 can be consulted and both applications are incorporated herein by reference. These applications also relate to the possibility, in the generic methods and apparatus, of varying values stored in a characteristic field and addressed as a function of engine operating characteristic quantities in accordance with a learning process in such a way that not only merely a single predetermined characteristic field value, but the various characteristic field values located in its vicinity as well, can be additionally modified so as to vary the particular characteristic field value in question. The procedure, in more, detail, is such (as described in the above-mentioned U.S. Pat. No. 4,676,215) that an integral regulator varies the value read out of the characteristic field continuously in a multiplicative manner during actual operation of the engine, but at the same time the multiplicative correction factor RF of the regulator is averaged and, upon leaving the influenced surrounding region or inclusion area of a particular support point, is incorporated as a mean value into the corresponding support point of the characteristic field. The characteristic field is divided up into a predetermined number of support points, so that intermediate values can be calculated by means of linear interpolation. In this manner it is possible on the one hand to adapt the characteristic field to the values predetermined by the regulator by means of varying the support points, and on the other hand to avoid the situation where only the addressed values of the characteristic field are capable of learning, which would be the case if there were only single-value adaptation.

In this connection, it is proposed in U.S. Pat. No. 4,827,937, that the disturbing quantities that make up the majority of the characteristic field changes and that operate multiplicatively be detected by the introduction of a so-called global factor and superimposed on the entire characteristic field, so that the field can be adapted substantially faster. As a result, areas in the characteristic field that are addressed only rarely, or very rarely, are adapted faster and correspondingly more accurately as well. It is also possible in such a system, by subdividing it into a basic characteristic field and a factor characteristic field that performs the self-adaptation (adaptive learning), to assure that the interpolation that is to be performed in the area of the basic characteristic field cannot have any disruptive effect on the learning process. The self-adapting factor characteristic field then serves primarily to take additive or structural influences and disturbing quantities into account, while multiplicative quantities, which typically make up a uniform proportion of the disturbing quantities, can be detected by means of a combination with the above-mentioned global factor, so that overall, it is possible to attain fast and optimal adaptation while taking structural and multiplicative influences into account.

However, it has been found that further improvements, in particular with respect to the transient phenomena, of the course of adaptation are still possible, especially in structural changes and in the parameter sensitivity.

SUMMARY OF THE INVENTION

It is therefore an object of the invention to optimize the area of the learning process, in a self-adapting gasoline injection system of the above-described type.

The method and the apparatus according to the invention have the advantage that with a reduced tendency to oscillate, an improvement of adaptation, an increase in the addressed factors, a more uniform course of adaptation and, if applicable, an indication only in the case of an unfavorable and hence avoidable selection of parameters are attained.

Optimization can also be attained by combining the various learning processes described in detail below with one another, as well as with the global factor already proposed in the above-referenced earlier applications; this also enables good carry-over of the nonaddressed factors as well.

The provisions according to the invention are particularly well suited for structural characteristic field displacements.

BRIEF DESCRIPTION OF THE DRAWINGS

The invention will now be described with reference to the drawings wherein.

DESCRIPTION OF THE PREFERRED EMBODIMENTS OF THE INVENTION

The invention relates to particular solutions concerning the block marked "learning method" in the various drawing figures and is therefore directed to possible learning strategies that assure the most optimal possible, or in other words the most accurate and fastest possible, self-adaptation of characteristic fields to changing disturbance quantities. In this connection, it is essential that the areas of the characteristic field that are not addressed, or are seldom addressed, are satisfactorily followed up as well.

It is therefore possible with the invention to improve the methods described in the earlier U.S. Pat. No. 4,676,215 and U.S. Pat. No. 4,827,937 referred to above in various ways, and so these patents are expressly incorporated by reference, so that the explanations given there need not be repeated here with respect to the subject of the present application.

Figure 1:
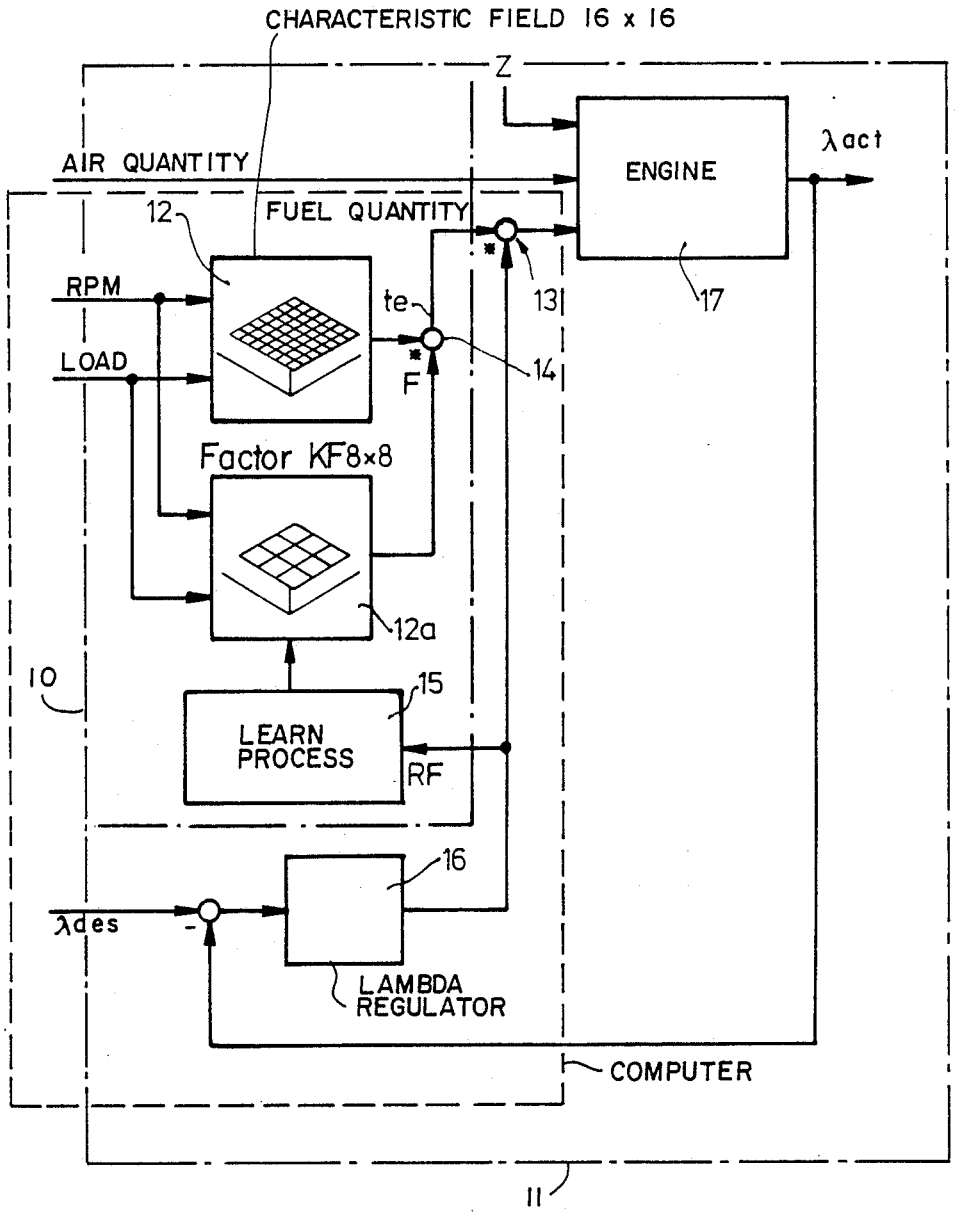
FIGS. 1 and 2, in block diagram form, provide a schematic illustration and explanation of the basic principle of a method of combined open-loop and closed-loop control for operating an internal combustion engine, in which based on ongoing closed-loop control an intervention is made in the area of rapid pilot control as well, to attain a relatively slow self-adaptation (adaptive learning) of the pilot control characteristic field.

In the block diagram of FIG. 1, a division has been made into a (pilot or anticipatory) control area 10, for rapidly furnishing a pilot control value, for example for the injection pulse time in a fuel injection system, and a regulation area 11 superposed on the control. This regulation area 11 has a multiplicative influence on the particular characteristic field value at 13, which is prepared by a characteristic field 12 having an associated factor characteristic field 12*a*. The anticipatory control area 10 emits the particular characteristic field value as a function of addresses delivered to it; in this case only rotational speed and load are shown. The value that is read out at 14 from the characteristic field 12 is selectively influenced multiplicatively by the factor characteristic field. The anticipatory control area 10 includes a block 15 for adaptive learning from the output value RF of a regulator 16, which is for example, but preferably, what is known as a lambda regulator, which is supplied with the actual value quantity $\lambda_{act}$ by a lambda sensor in the exhaust gas area of the internal combustion engine 17. The regulator is capable of evaluating any arbitrary, suitable actual-value quantity of the controlled system represented by the engine.

In the schematic block diagram of a self-adapting gasoline injection system shown in FIG. 1, the basic characteristic field 12 for the injection time is represented by 16×16 support points. This characteristic field is divided into 8×8 areas, and each area is assigned a factor by which the basic injection time is multiplied via the learning factor characteristic field 12*a*. In dependence upon the regulating factor RF (the output value of the lambda regulator 16), the particular factors are adapted by means of the block 15 corresponding to the particular learning method.

A common feature of all the learning methods is that adaptation is done, or can be done, only at stationary operating points; after a predetermined transient time has elapsed, the regulating factor RF is averaged (block 18 for average-value formation in FIG. 2), and after averaging, the regulating factor $\overline{RF}$ is entered into the factor characteristic field 12*a*.

Figure 2:
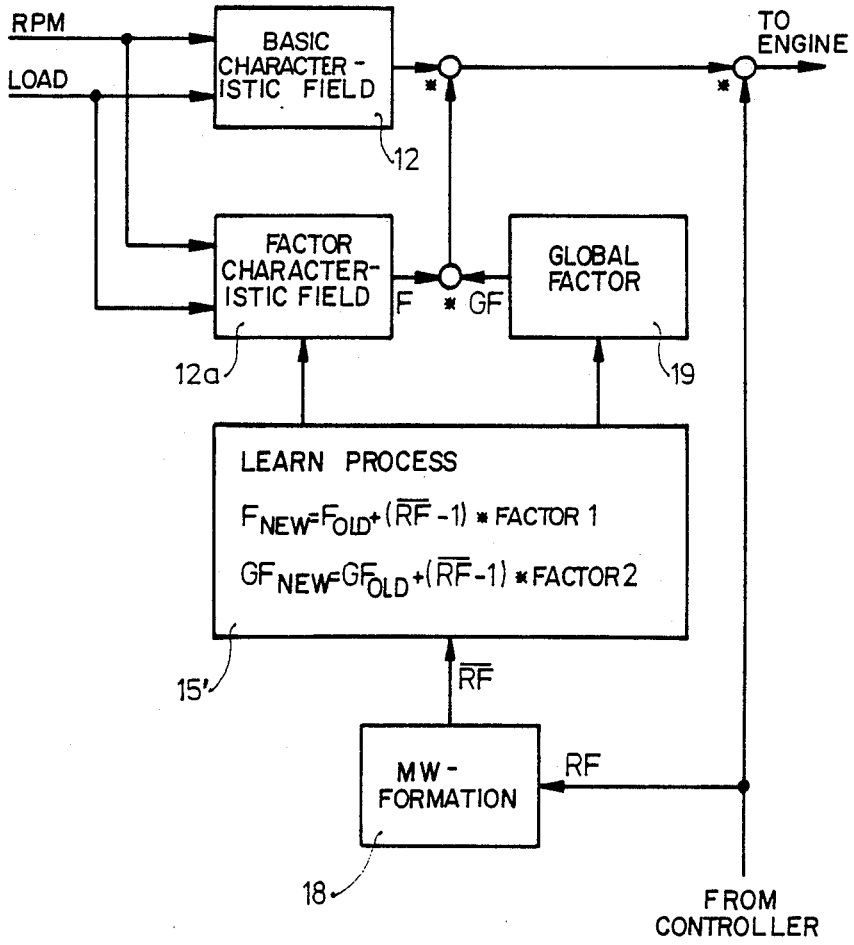

In the more-detailed illustration in FIG. 2, the learning method is based both on the adaptation of the factors of the factor characteristic field 12*a* and of the above-mentioned global factor by means of the block 19, which (without addressing) multiplicatively shifts the entire basic characteristic field. The formulas for calculating the particular factor of the factor characteristic field or the global factor are provided in block 15', marked learning method, of FIG. 2 and need not be repeated here; the weighting factors, factor 1 and factor 2, can be varied, but the sum must not be greater than 1.0, to avoid a tendency of the system to oscillate.

Figure 3:
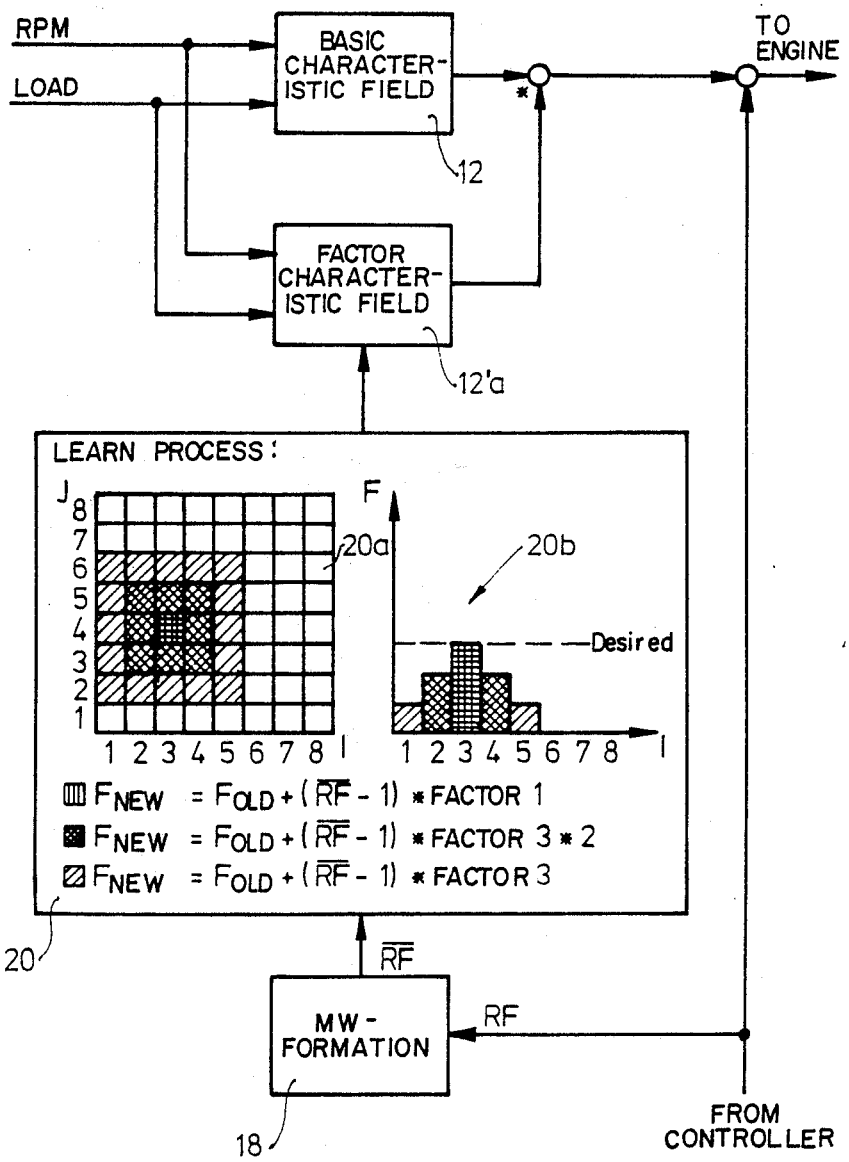
FIG. 3, again in block diagram form, illustrates a first embodiment of the invention in which the learning method—the so-called tent-roof learning method—also affects the factor characteristic field associated with the basic characteristic field of the anticipatory control, by also varying the area located around a particular support point, with decreasing influence toward the outside.

As shown in FIG. 3, according to a feature of the invention the learning method is modified for the factor characteristic field 12*a'* in such a way that—while dispensing with the forming of a global factor—the area around the particular factor characteristic field support point that is addressed by the input data of rotational speed and load is also changed in association with the evaluation of the averaged regulating factor RF, with a decreasing influence toward the outside, as indicated in the two diagrams 20*a* and 20*b* given in block 20 for this method, which is thus known as the tent-roof learning method. Accordingly, when the directly addressed (correction) factor is newly calculated for the factor characteristic field, the basis is formed for the full variation factor value of "factor 1", while the eight support point areas directly adjoining this support point area enter into the new calculation only with the new calculation factor of $\frac{2}{3}$, as shown by way of example in block 20 in FIG. 3, and with decreasing influence toward the outside, the further sixteen support points adjoining these eight support points enter into the adaptation only with the variation factor of $\frac{1}{3}$. This tent-roof learning method therefore assures a very fast and inclusive adaptation of the anticipatory control values based on the averaged regulating factor, in particular in the stronger or in other words repeatedly addressed areas, with overall a reduced tendency to oscillation and an attenuated course of adaptation only in the event of an unfavorable selection of parameters.

Figure 4:
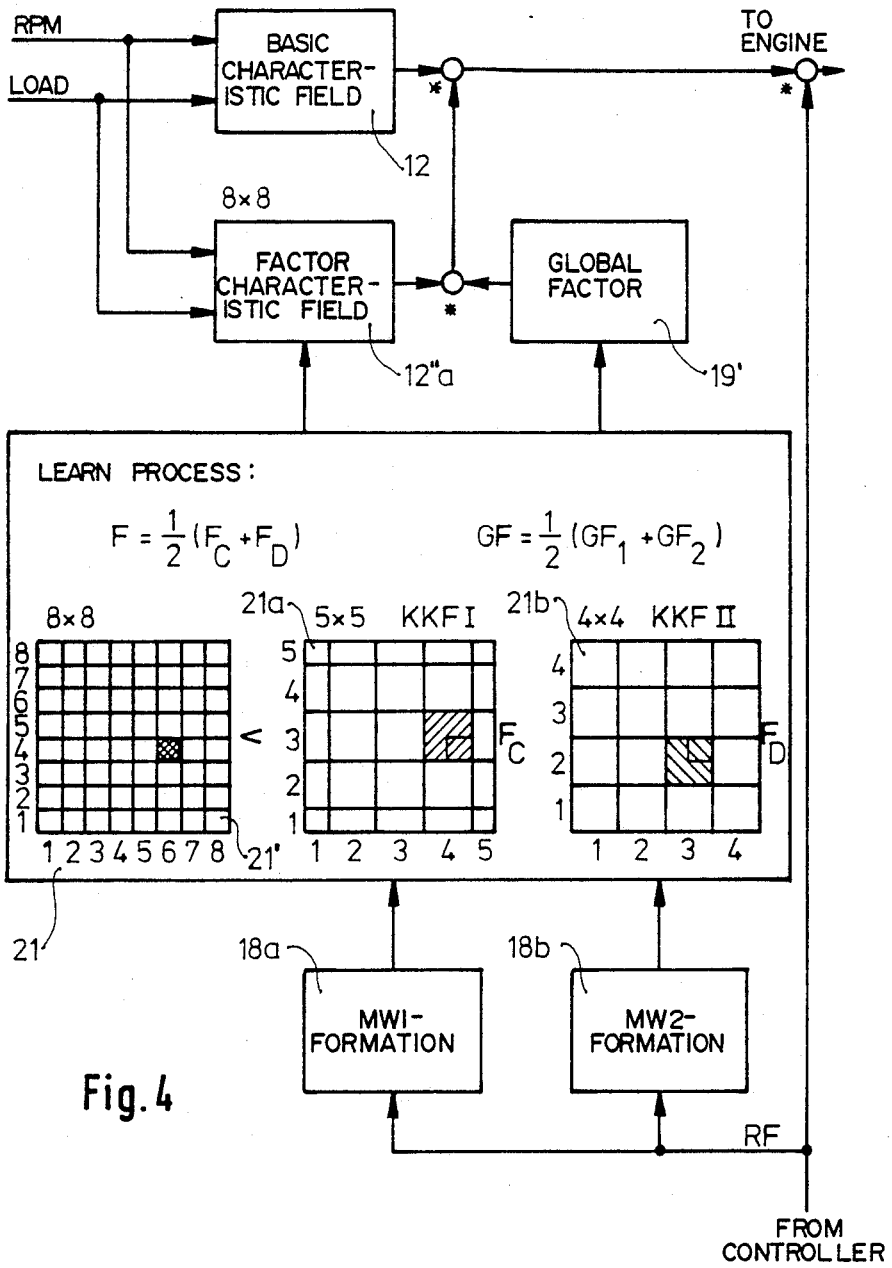
FIG. 4 illustrates another embodiment of the invention in which the learning method is overlapping, preferably including the global factor, that is, in which a plurality of smaller factor characteristic fields having relatively large inclusion areas are formed, overlapping one another, so that upon small fluctuations of the input quantities, at least one of the characteristic fields is addressed.

An alternative, or preferably supplementary, further option for modifying the learning method is shown in FIG. 4 and is based on the observation of previous learning systems that an adaptation can never take place whenever one of the input quantities is fluctuating about the border of an area (the borders being after all arbitrarily defined). Such fluctuation means that a counter that is provided for determining the transient time will always already have been newly reset before the final value is reached, so that it is impossible to enter or take over change values arriving from the regulation via the averaged regulating factor.

Therefore, in accordance with a further feature of the invention, the procedure is such that the basis for the factor characteristic field is two smaller factor characteristic fields (a division into 5×5 or 4×4 areas, is shown as an example), which however are larger, as the smaller diagrams at 21*a* and 21*b* in learning method block 21 suggest, and overlap one another in such a way that one of the characteristic fields will always be addressed in any case in the event of relatively small fluctuations of the input quantities. A comparison of the two factor characteristic fields 21*a* and 21*b*, henceforth called correcting characteristic fields I and II (KKF I and KKF II in the drawing), with the original factor characteristic field at 21' shows in fact that the support point area assumed there at 4/6 in the correcting characteristic field I and which is addressed for example by the particular input quantities and which is located in the lower right corner of the larger shaded inclusion area, while the same support point area in the correcting characteristic field II is located in the upper right corner of the larger inclusion area, and so therefore overlap as shown; because, no matter in which peripheral area of the support point 4/6 of the original factor characteristic field 21' the input quantities are fluctuating, they will not leave either the enlarged inclusion area of the correcting characteristic field I or that of the correcting characteristic field II as a result, and so adaptation or recalculation of either the factor $F_C$ of correcting characteristic field I or factor $F_D$ of correcting characteristic field II is possible. The mean value of these two factors $F_C$ and $F_D$ then forms the final factor F, as indicated in the learning process block 21. The formation of a mean value of the regulating factor RF is effected separately for the two correcting characteristic fields, via separate mean value forming blocks 18*a*, 18*b*.

In this "overlapping" learning process, a global factor is preferably formed for each characteristic field, as already shown in FIG. 2, and then in accordance with the calculation formula also given in block 21 this is combined into one common global factor.

Figure 6:
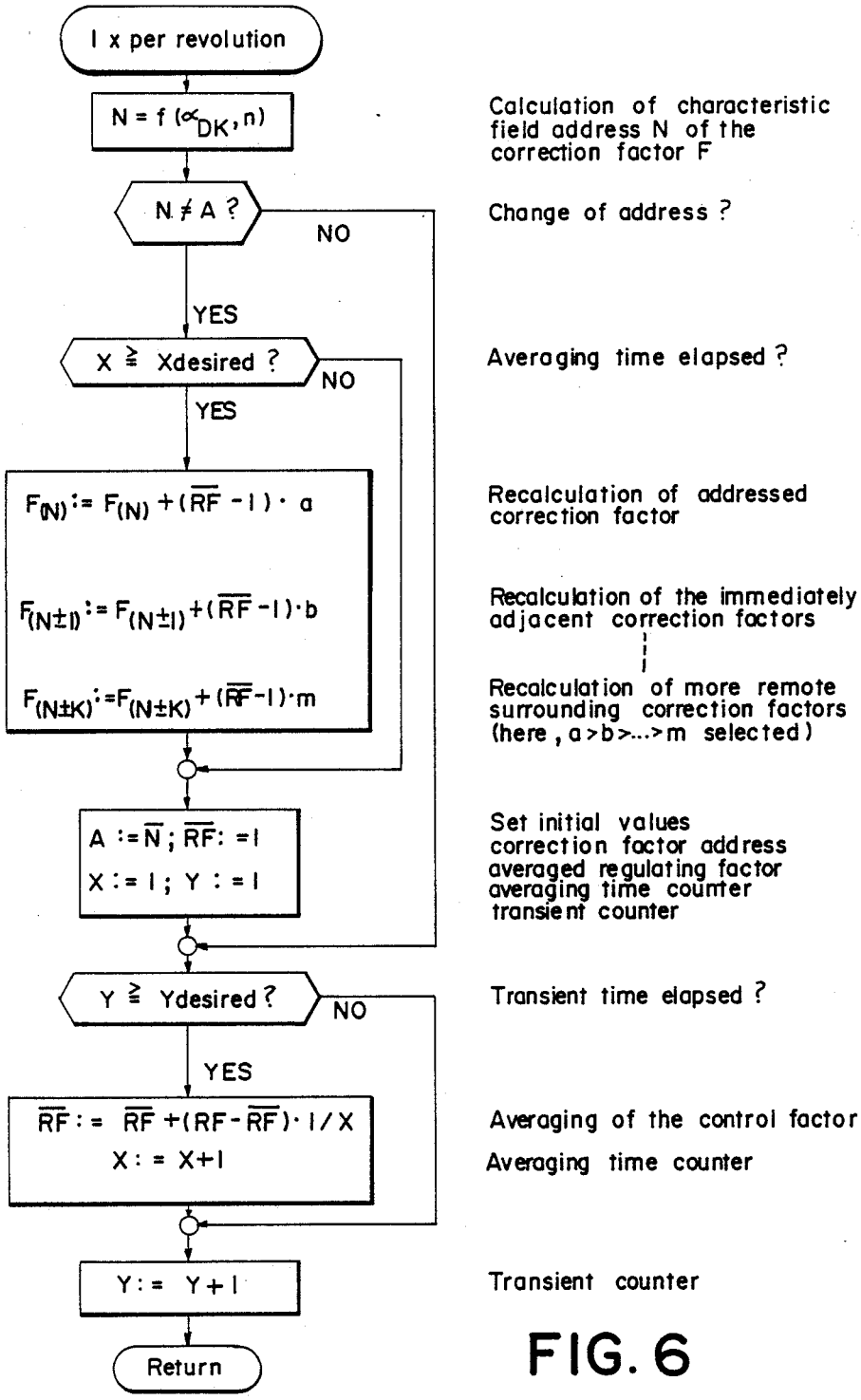
FIG. 6 is a flow chart for the tent-roof characteristic field learning process and relates to the block diagram of FIG. 3; and, FIG. 7 is a flow chart of the overlapping learning process performed by adaptation of the correcting characteristic fields I and II.

A flow chart for the tent-roof characteristic field learning diagram is provided in FIG. 6 and relates to FIG. 3.

The flow chart of FIG. 7 pertains to the embodiment of the invention referred to above as the overlapping learning process, performed by adaptation of correcting characteristic fields I and II.

A particularly advantageous feature of the overlapping learning process is that there is an increase in the factors addressed, while at the same time the tendency to oscillation is reduced and adaptation is improved. If both learning methods, the tent-roof method and the overlapping method, are used in combination, as indicated in the last flow chart by the alternative branch route, then the procedure is advantageously that shown in FIG. 5. While retaining separate mean value formation of the regulating or control factor via the blocks 18*a* and 18*b* and corresponding addressing of the two correcting characteristic fields I and II, which are represented at 21*a'* and 21*b'*, the procedure is then such that in addition, around the already enlarged inclusion area, the further support point inclusion areas located around it are also varied as well, with lessening influence; the calculation formulas used for this, as in FIG. 3, are shown in block 21' of the learning process by means of small boxes provided with appropriate shading or identifying marks. It will also be understood that although the terms "factor 1" and "factor 2" may represent equal weighting as explained above, in the combination of the overlapping and tent-roof learning methods only the directly adjoining support point areas undergo a change, with progressively lessening influence, in the correcting characteristic fields I and II.

Figure 5:
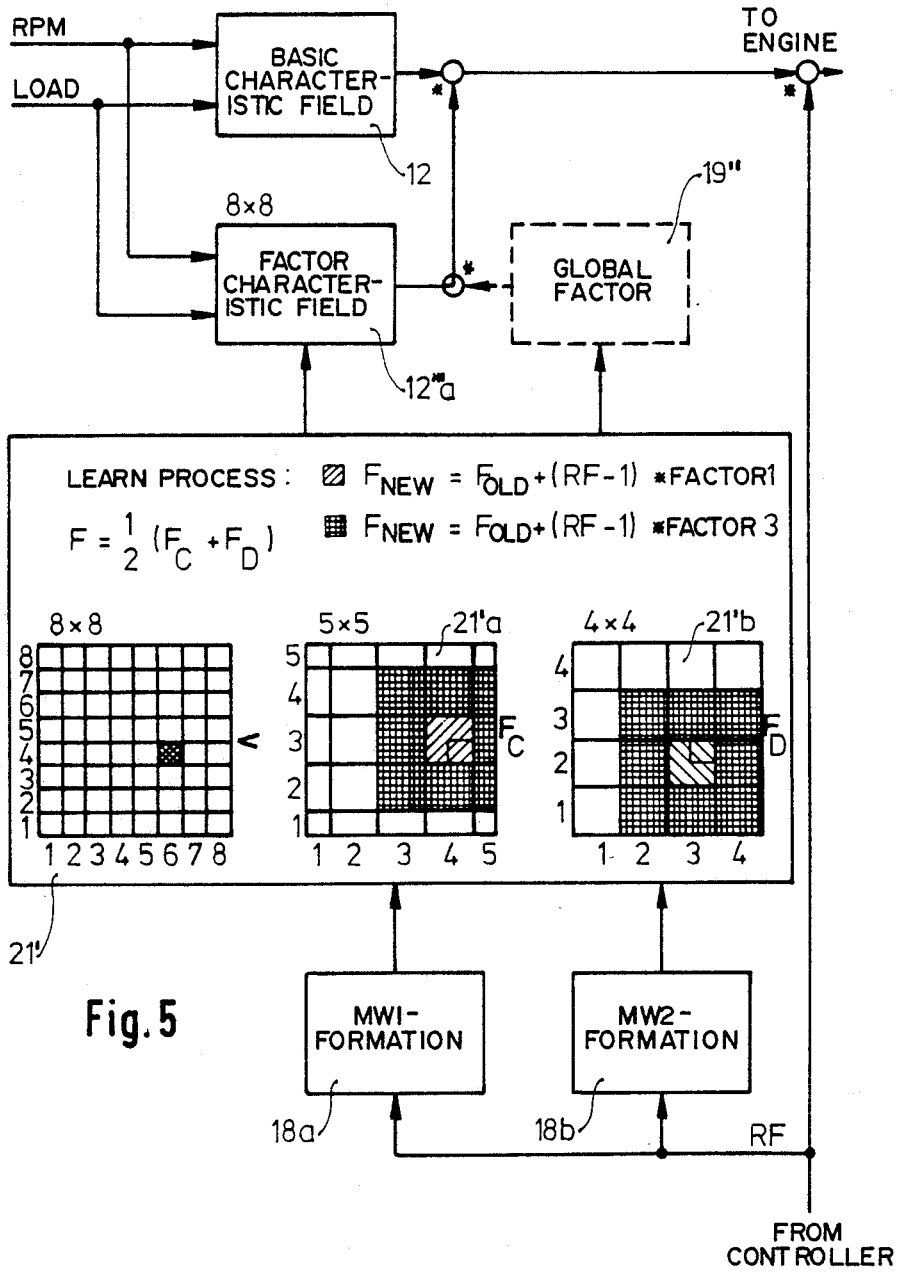
FIG. 5 illustrates a combination of the above two learning methods, with an enlargement of the inclusion areas in both factor characteristic fields, once again shown in the form of a block diagram.

It may be desirable also to use a global factor in this combined process, should this prove useful for particular engines and particular operating states; this option is merely suggested by dashed lines in the block in FIG. 5.

It is understood that the foregoing description is that of the preferred embodiments of the invention and that various changes and modifications may be made thereto without departing from the spirit and scope of the invention as defined in the appended claims.

What is claimed is:

1. Method for controlling operating characteristic quantities of an internal combustion engine by calculating values for an anticipatory control for metering fuel, the method including a characteristic field having values of engine operating quantities stored therein for anticipatorily controlling engine variables influencing the operating characteristic quantities, the engine including a regulator for forming a control factor RF, the method comprising the steps of:

correctively influencing the particular emitted characteristic field values with a control device sensitive to at least one engine variable as an actual value;

changing values stored in the characteristic field via said control device for correcting the characteristic field values, the stored values being addressed in dependence upon operating quantities of the engine such as speed and load;

averaging the control factor RF to form an averaged control factor $\overline{RF}$;

with a factor characteristic field associated with the basic characteristic field and whose area factors multiplicatively operate on data emitted from the basic characteristic field and with adaptive take over from the averaged control factor $\overline{RF}$, also selectively changing, for a predetermined factor area defining a support point having a support point factor, the area surrounding this support point outwardly;

said factor characteristic field having a plurality of support points and, with adaption of one of said support points, the change of the area surrounding said support point takes in an inner ring of the other support points directly adjoining said area and at least one further outer ring of the other support points surrounding said inner ring of support points; and, with the support points directly affected, the support points of the inner ring all being changed with respective different weighting;

forming quantities for metering fuel to the engine from the following: said characteristic field values of said basic characteristic field, the values of said factor characteristic field and said control factor RF; and, controlling a device for metering fuel to the engine which meters fuel to the engine in correspondence to the value of one of said quantities.

2. The method of claim 1, wherein the basis of the factor characteristic field is two smaller corrective characteristic fields I and II and the areas of the corrective characteristic fields I and II are enlarged at least by the directly adjoining support point factors.

3. The method of claim 2, wherein, in addition to each corrective characteristic field, a global factor is prepared from the change of the characteristic field values as a predetermined portion of the averaged value $\overline{RF}$of the control factor; and, the average value of the partial factors forms a final global factor for supplementingly and multiplicatively shifting all basic characteristic field data.

4. The method of claim 2, wherein the average value formation of the control factor for both corrective characteristic fields is carried out separately.

5. The method of claim 1, wherein, the adaption of the support point, the change of the area surrounding a factor characteristic field support point takes in an inner ring of support points directly adjoining said area and at least one further outer ring of support points surrounding said inner ring of support points; and, with the support point directly affected, the support points of the inner ring and the outer rings all being changed with respective different weighting.

6. Method for controlling operating characteristic quantities of an internal combustion engine by calculating values for an anticipatory control for metering fuel, the method including a characteristic field having values of engine operating quantities stored therein for anticipatorily controlling engine variables influencing the operating characteristic quantities, the engine including a regulator for forming a control factor RF, the method comprising the steps of:

correctively influencing the particular emitted characteristic field values with a control device sensitive to at least one engine variable as an actual value;

changing values stored in the characteristic field via said control device for correcting the characteristic field values, the stored values being addressed in dependence upon operating quantities of the engine such as speed and load;

storing several smaller factor corrective characteristic fields I and II to prevent omitted adaptation when passing over area boundaries of input operating quantities, said factor corrective characteristic fields I and II having larger inclusion areas with reference to a particular support point of the factor characteristic field; and, with these inclusion areas overlapping each other in such a way that with small fluctuations of the input quantities, addressing at least one of the corrective characteristic fields via a separate mean value formation of the control factor RF to form an averaged control factor $\overline{RF}$;

forming quantities for metering fuel to the engine from the following: said characteristic field values of said basic characteristic field, the values of said factor characteristic field and said control factor RF; and, controlling a device for metering fuel to the engine which meters fuel to the engine in correspondence to the value of one of said quantities.

7. The method of claim 6, wherein the enlargement of the mutually overlapping influence areas of both of the corrective characteristic fields I and II is so made that the enlarged influence areas of each corrective characteristic field surrounds the original support point on different sides in such a manner that at least one of the corrective characteristic fields is also addressed when one of the input quantities fluctuates about an area boundary of the base raster of the factor characteristic field.

8. Apparatus for controlling operating characteristic quantities of an internal combustion engine by calculating values for an anticipatory control for metering fuel, with a characteristic field having values of engine operating quantities stored therein for anticipatorily controlling engine variables influencing the operating characteristic quantities, the apparatus comprising:

a control device sensitive to at least one engine variable as an actual value;

means for correctively influencing the particular characteristic field values emitted by said characteristic field with said control device;

a factor characteristic field associated with said characteristic field;

means for changing values stored in the factor characteristic field via said control device for correcting the characteristic field values, the stored values being addressed in dependence upon operating quantities of the engine such as speed and load;

means for storing at least two corrective characteristic fields I, II operating in common as a factor characteristic field, the influence areas of the corrective characteristic fields being configured so as to be larger than the basic raster of the factor characteristic field and being so determined that said influence areas mutually overlap so that at least one of the corrective characteristic fields is addressed when an input quantity fluctuates about an area limit quantity;

weighting means for also changing areas adjoining the particular support point with reduced influence outwardly;

means for forming quantities for metering fuel to the engine from the following: said characteristic field values of said basic characteristic field, the values of said factor characteristic field and said control factor RF; and, means for controlling a device for metering fuel to the engine which meters fuel to the engine in correspondence to the value of one of said quantities.

* * * * *